US009223280B2

(12) United States Patent
Hirata et al.

(10) Patent No.: US 9,223,280 B2
(45) Date of Patent: Dec. 29, 2015

(54) IMAGE FORMING APPARATUS

(71) Applicants: Hironori Hirata, Nagoya (JP); Koyo Yamamoto, Nisshin (JP)

(72) Inventors: Hironori Hirata, Nagoya (JP); Koyo Yamamoto, Nisshin (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/021,204

(22) Filed: Sep. 9, 2013

(65) Prior Publication Data

US 2014/0093256 A1 Apr. 3, 2014

(30) Foreign Application Priority Data

Sep. 28, 2012 (JP) ..... 2012-217145

(51) Int. Cl.
*G03G 15/00* (2006.01)
*G03G 15/043* (2006.01)
*G03G 21/16* (2006.01)

(52) U.S. Cl.
CPC ..... *G03G 15/55* (2013.01); *G03G 15/043* (2013.01); *G03G 21/1633* (2013.01)

(58) Field of Classification Search
CPC ..... G03G 15/043
USPC ..... 399/405
See application file for complete search history.

(56) References Cited

U.S. PATENT DOCUMENTS 4,939,553 A * 7/1990 Sato et al. ..... 399/16
5,519,483 A * 5/1996 Kawanishi et al. ..... 399/45
7,263,312 B2 * 8/2007 Park ..... 399/124
8,253,992 B2 * 8/2012 Shoda et al. ..... 358/474
8,913,256 B2 12/2014 Sellers
8,953,226 B2 * 2/2015 Fujimura et al. ..... 358/449
2002/0081134 A1 * 6/2002 Miyamoto et al. ..... 399/405
2003/0030718 A1 * 2/2003 Maeda ..... 347/250
2004/0022548 A1 * 2/2004 Nagaoka ..... 399/16
2005/0141939 A1 * 6/2005 Kayama et al. ..... 399/405
2007/0076085 A1 4/2007 Kim (Continued)

FOREIGN PATENT DOCUMENTS

CN 1940751 A 4/2007
CN 102193369 A 9/2011
JP 2002-356004 A 12/2002
JP 2006-227464 A 8/2006

OTHER PUBLICATIONS

Notification of First Office Action dated Aug. 28, 2015 received in related CN 201310446344.0 together with an English language translation.

*Primary Examiner* — Anthony Nguyen
(74) *Attorney, Agent, or Firm* — Scully, Scott, Murphy & Presser, P.C.

(57) ABSTRACT

A light source is provided in the casing and emits a light beam for forming an image. A first sensor receives the light beam emitted by the light source and outputs a light reception signal. A cover opens and closes relative to the casing. A shutter prevents the first sensor from receiving the light beam when the cover is at an open position, and allows the first sensor to receive the light beam when the cover is at a closed position. A controller is configured to: execute a lighting process of lighting the light source; execute a first determining process of determining whether the light reception signal is outputted from the first sensor, in response to the lighting process; and determine that the cover is at the open position upon determination in the first determining process that no light reception signal is outputted.

20 Claims, 12 Drawing Sheets

(56) References Cited

U.S. PATENT DOCUMENTS

2011/0091222 A1* 4/2011 Kim et al. ..... 399/9
2011/0216144 A1 9/2011 Takada
2012/0194630 A1* 8/2012 Murota ..... 347/261
2012/0243054 A1* 9/2012 Sellers ..... 358/448

* cited by examiner

IMAGE FORMING APPARATUS

CROSS REFERENCE TO RELATED APPLICATIONS

This application claims priority from Japanese Patent Application No. 2012-217145 filed Sep. 28, 2012. The entire content of the priority application is incorporated herein by reference.

TECHNICAL FIELD

The invention relates to an image forming apparatus.

BACKGROUND

An electrophotographic-type image forming apparatus includes an exposure device that exposes a photosensitive member to light. Hence, it is preferable that, when a cover is opened, light such as laser light emitted from the exposure device does not leak to the outside. A known image forming apparatus is provided with a shutter and an open/close sensor switch. The shutter mechanically blocks laser light when the cover is opened. The open/close sensor switch mechanically detects an open/close state of the cover.

SUMMARY

By providing the open/close sensor switch, opening of the cover can be detected. However, because the open/close sensor switch mechanically detects the open/close state of the cover, there is a possibility that the apparatus becomes large.

In view of the foregoing, it is an object of the invention to provide a technology for downsizing an image forming apparatus having a shutter for blocking a light path of a light beam, while determining that a cover is opened.

In order to attain the above and other objects, the invention provides an image forming apparatus. The image forming apparatus includes a casing, a light source, a first sensor, a cover, a shutter, and a controller. The light source is provided in the casing and is configured to emit a light beam for forming an image. The first sensor is configured to receive the light beam emitted by the light source and to output a light reception signal. The cover is configured to open and close relative to the casing. The shutter is configured to prevent the first sensor from receiving the light beam when the cover is at an open position, and to allow the first sensor to receive the light beam when the cover is at a closed position. The controller is configured to: execute a lighting process of lighting the light source; execute a first determining process of determining whether the light reception signal is outputted from the first sensor, in response to the lighting process; and determine that the cover is at the open position upon determination in the first determining process that no light reception signal is outputted.

BRIEF DESCRIPTION OF THE DRAWINGS

Embodiments in accordance with the invention will be described in detail with reference to the following figures wherein.

DETAILED DESCRIPTION

Embodiment

A printer as an example of an image forming apparatus according to an embodiment of the invention will be described while referring to FIGS. 1 through 12.

1. Configuration of Printer

The configuration of a printer 1 will be described while referring to FIGS. 1 and 2. In the following description, the right side of FIG. 1 is defined as the front side of the printer 1, the left side of FIG. 1 is defined as the rear side of the printer 1, the near side in a direction perpendicular to the sheet of FIG. 1 is defined as the left side of the printer 1, and the far side in the direction perpendicular to the sheet of FIG. 1 is defined as the right side of the printer 1.

Figure 1:
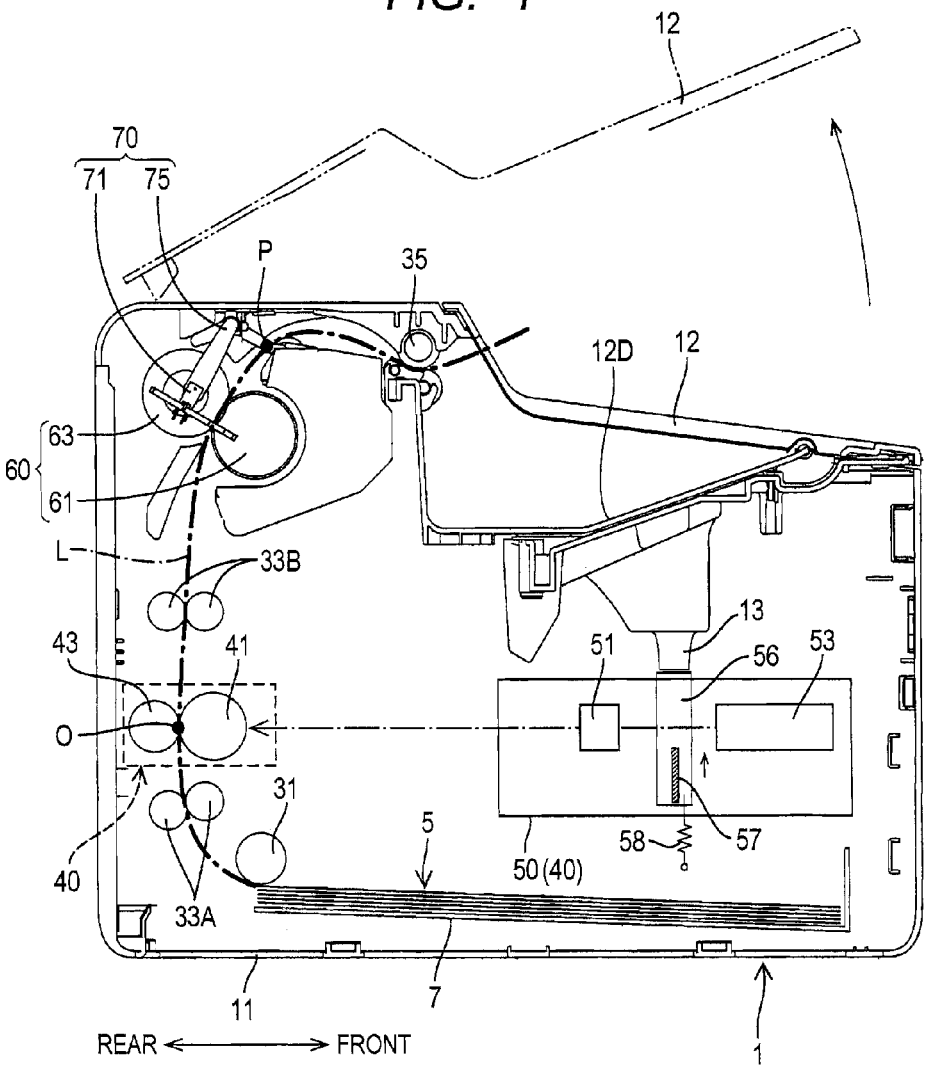
FIG. 1 is a side cross-sectional view showing the relevant parts of a printer according to an embodiment.

As shown in FIG. 1, the printer 1 includes a box-shaped casing 11 covering the internal components. An upper-side wall of the casing 11 constitutes a top cover 12 that is configured to open/close in the upper-lower direction about a hinge provided at the rear end of the apparatus. When the top cover 12 is opened, the upper side of the casing 11 is opened, so that a user can access the inside of the casing 11. Note that the top cover 12 is an example of a cover.

A conveying mechanism, a printing section 40, an exposing section 50, a fixing unit 60, and a paper discharge sensor 70 are provided within the casing 11. The conveying mechanism picks up paper 5 serving as a recording medium (an example of a sheet) one sheet at a time from a tray 7 provided at a lower portion of the printer 1, and conveys the picked-up paper 5 along a conveying path L. The conveying mechanism includes various rollers such as a paper feeding roller 31, conveying rollers 33A and 33B, a paper discharge roller 35, etc. The paper feeding roller 31 feeds paper 5 from the tray 7. The conveying rollers 33A convey the fed paper 5 to a transfer position O. The conveying rollers 33B convey the paper 5 having passed the transfer position O to the fixing unit 60. The paper discharge roller 35 discharges the paper 5 subsequent to a printing process to the outside of the apparatus. Note that the conveying rollers 33A and 33B are an example of a conveying section.

The printing section 40 serves to print an image (a developer image) on the paper 5 that is conveyed along the conveying path L. The printing section 40 include a photosensitive drum 41, a transfer roller 43, the exposing section 50, a charger (not shown) that charges the surface of the photosensitive drum 41, a developing roller (not shown), and the like, so as to print an image on the paper 5 with an electrophotographic method.

The exposing section 50 emits light in accordance with image data inputted from the outside, thereby serving to expose the photosensitive drum 41 that is charged by the charger. At the transfer position O, the transfer roller 43 transfers, onto the paper 5, a developer image that is developed by the developing roller with developer after an electrostatic latent image is formed on the photosensitive drum 41 due to exposure by the exposing section 50.

The fixing unit 60 is disposed at the downstream side of the photosensitive drum 41, and includes a heat roller 61, a pressure roller 63, and the like. The fixing unit 60 serves to thermally fix the developer image that is transferred onto the paper 5 while the paper 5 passes between the rollers 61 and 63. Then, the paper 5 to which the developer image is thermally fixed is discharged to the outside of the apparatus via the paper discharge roller 35. Specifically, the paper 5 is discharged to a paper discharge section 12D formed in a concave shape in the top cover 12.

2. Configuration of Exposing Section and Blocking of Laser Light with Shutter

Figure 2:
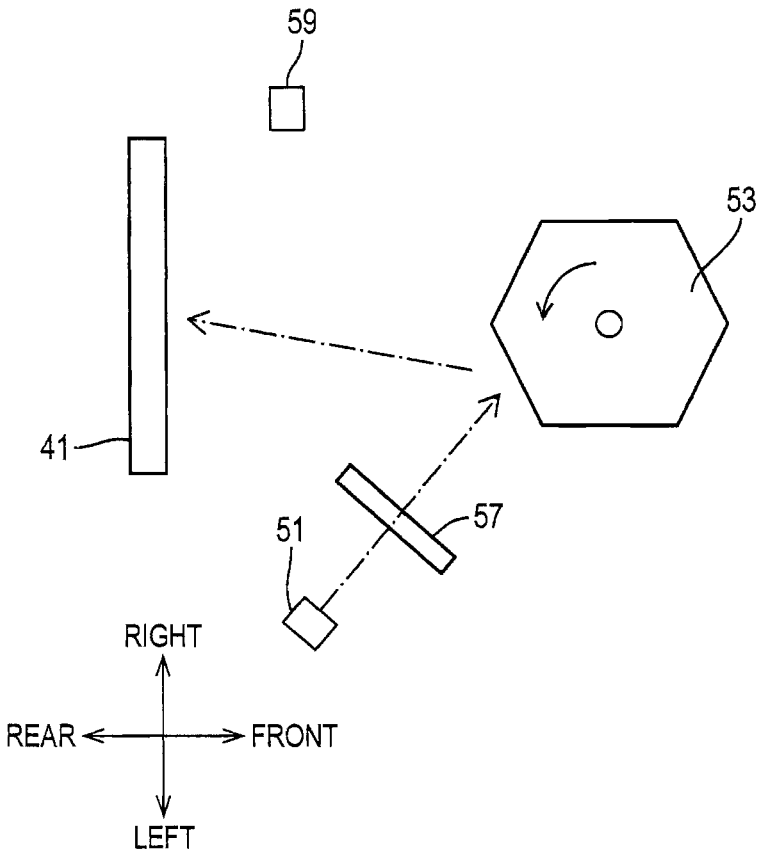
FIG. 2 is a plan view of an exposing section.
Figure 7:
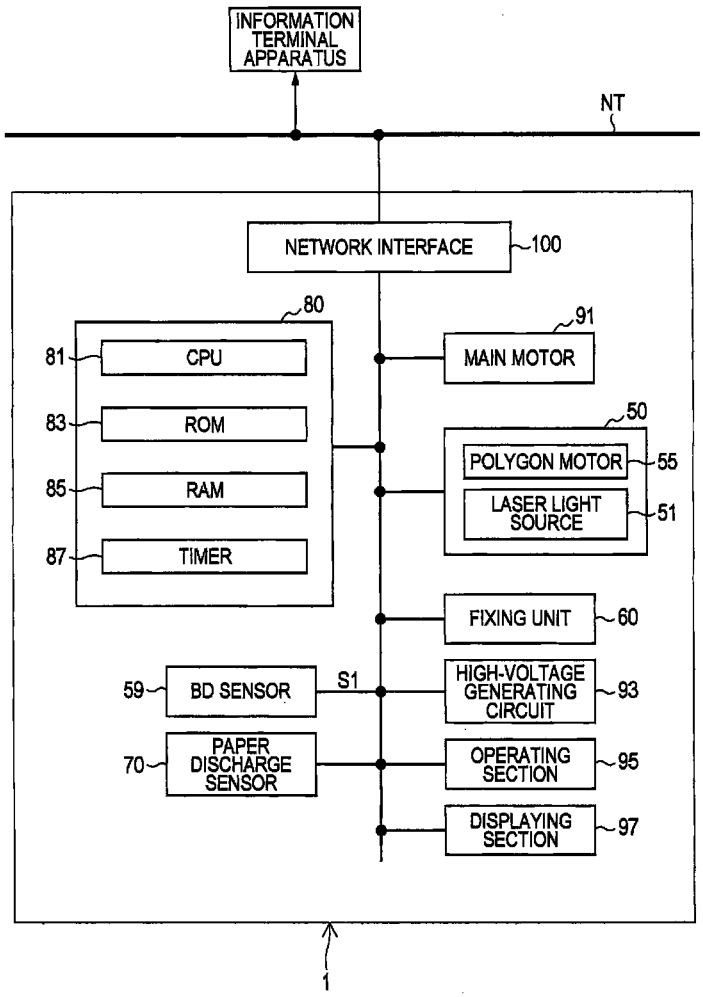
FIG. 7 is a block diagram showing the electrical configuration of the printer.
Figure 8:
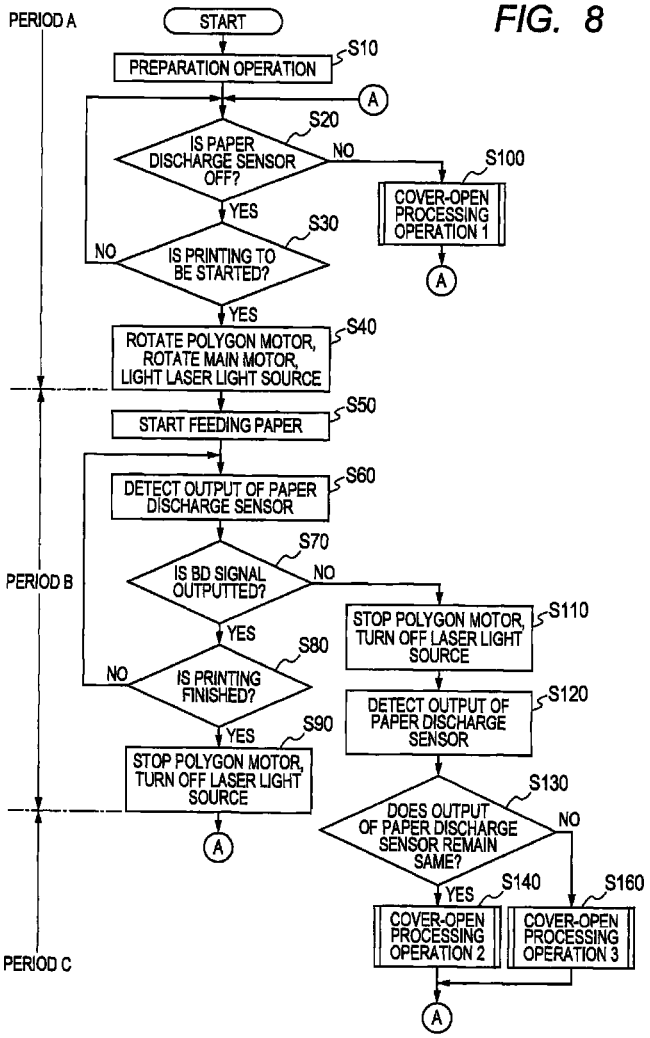
FIG. 8 is a flowchart showing the process flow of a cover-open detection sequence.

As shown in FIGS. 1, 2, and 7, the exposing section 50 includes a laser light source 51, a polygon mirror 53, a polygon motor 55 (FIG. 7), a shutter 57, and the like. The laser light source 51, the polygon mirror 53, and the photosensitive drum 41 are arranged with each other in a horizontal direction. That is, the laser light source 51, the polygon mirror 53, and the photosensitive drum 41 are arranged on an imaginary horizontal plane. The polygon mirror 53 is driven to rotate by the polygon motor 55, while deflecting laser light (light beam) emitted from the laser light source 51 in horizontal directions, thereby scanning, at high speed, the laser light onto the surface of the photosensitive drum 41 that is uniformly positively-charged by the charger. Note that the laser light source 51 is an example of a light source, and that the polygon mirror 53 is an example of a deflector.

The shutter 57 is disposed between the laser light source 51 and the polygon mirror 53. As shown in FIG. 1, in a state where the top cover 12 is closed (the position of the top cover 12 shown by the solid lines in FIG. 1), the shutter 57 is located at a lower position than the laser light source 51. Hence, when laser light is emitted from the laser light source 51 in a state where the top cover 12 is closed, the laser light passes the upper side of the shutter 57 and is irradiated onto a surface of the polygon mirror 53, without being blocked by the shutter 57.

On the other hand, the shutter 57 is configured to move upward (indicated by the arrow in FIG. 1) in an interlocking manner with (in conjunction with) opening of the top cover 12. In a state where the top cover 12 is opened (the position of the top cover 12 shown by the two-dot chain lines in FIG. 1), the shutter 57 is located at the front side of the laser light source 51 so as to block laser light. Hence, the shutter 57 is configured, in a state where the top cover 12 is opened, to prevent laser light from being irradiated onto the surface of the polygon mirror 53.

Figure 3:
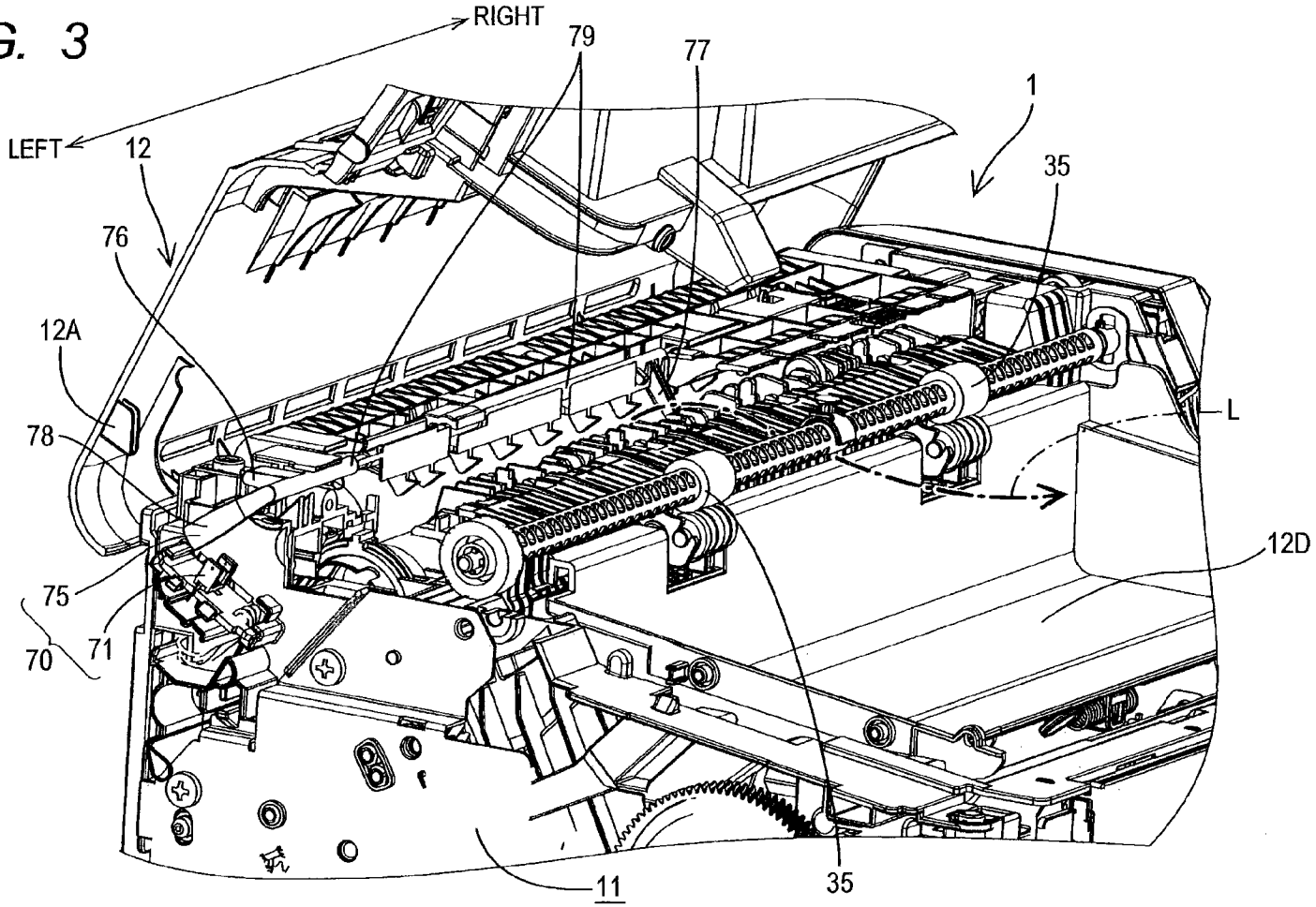
FIG. 3 is an enlarged perspective view showing a paper discharge sensor and the surrounding parts.

The mechanism described below is illustrated as an example of a mechanism for moving the shutter 57 in an interlocking manner with opening of the top cover 12. As shown in FIG. 1, a pressing member 13 is provided at the top cover 12. More specifically, the pressing member 13 is fixed to the lower side of the paper discharge section 12D. Thus, when the top cover 12 is opened, the pressing member 13 moves upward integrally with the top cover 12. In FIG. 3, the paper discharge section 12D is not moved integrally with the top cover 12, for the illustration purposes. However, in the actual configuration, the paper discharge section 12D moves integrally with the top cover 12 and the paper discharge roller 35. Further, a holder 56 holding the shutter 57 is provided. The holder 56 includes a pair of holding plates for holding left and right ends of the shutter 57, and is configured not to block laser light emitted from the laser light source 51. The holder 56 is movable in the upper-lower direction integrally with the shutter 57, and is urged upward by a spring 58. The spring 58 is provided at the casing 11. With this configuration, in a state where the top cover 12 is closed, the pressing member 13 presses the holder 56 down to a position shown in FIG. 1 so that the shutter 57 is located at a lower position than the laser light source 51. On the other hand, in a state where the top cover 12 is opened, downward pressing by the pressing member 13 is released, and the holder 56 and the shutter 57 move upward due to the urging force of the spring 58, so that the shutter 57 is located at the front side of the laser light source 51.

As shown in FIG. 2, the exposing section 50 is provided with a BD (Beam Detector) sensor 59. The BD sensor 59 is an optical sensor having a light receiving element. Upon reception of a level of light exceeding a threshold value, the BD sensor 59 outputs a BD signal S1 as a pulse signal. Note that the BD sensor 59 is an example of a first sensor, and the BD signal S1 is an example of a light reception signal.

Specific detecting operations will be described. The BD sensor 59 is disposed to, when the polygon mirror 53 is at a predetermined angle, receive reflected light that is emitted by the laser light source 51 and that is reflected by the surface of the polygon mirror 53. Hence, when the laser light source 51 is driven, the BD sensor 59 outputs the BD signal S1 with a scanning cycle T at which the polygon mirror 53 scans the photosensitive drum 41 with laser light.

3. Paper Discharge Sensor

The paper discharge sensor 70 is provided on the conveying path L in the printer 1. As shown in FIG. 1, the paper discharge sensor 70 includes a photoelectric sensor 71 and an interlocking member 75, so as to detect an existence of the paper 5 that passes a detection position P between the fixing unit 60 and the paper discharge roller 35.

Specifically, the photoelectric sensor 71 includes a pair of a light emitting element and a light receiving element that are arranged to confront each other. Note that the photoelectric sensor 71 in the present embodiment is a transmission-type photoelectric sensor (photo-interrupter) having these light emitting element and light receiving element as a package. As shown in FIG. 3, the photoelectric sensor 71 is attached to a left end portion of the rear side of the casing 11.

As shown in FIGS. 3 through 6, the interlocking member 75 is rotatable about a hinge H (axis), and includes a first arm 76, a second arm 77, a third arm 78, and a shaft portion 79. The shaft portion 79 has a shape elongated in the left-right direction of the printer 1, and is supported to be rotatable relative to the casing 11. Note that the shaft portion 79 extends over substantially the left half of the printer 1 in the left-right direction. The first arm 76, the second arm 77, and the third arm 78 are attached to the shaft portion 79. The first arm 76 and the third arm 78 are located at the left end portion of the shaft portion 79, and are configured not to contact the paper 5 passing through the conveying path L. On the other hand, the second arm 77 is provided at substantially a center portion of the paper conveying path in the paper width direction (the left-right direction), and is configured to contact, at the detection position P, the paper 5 passing through the conveying path L.

Figure 4:
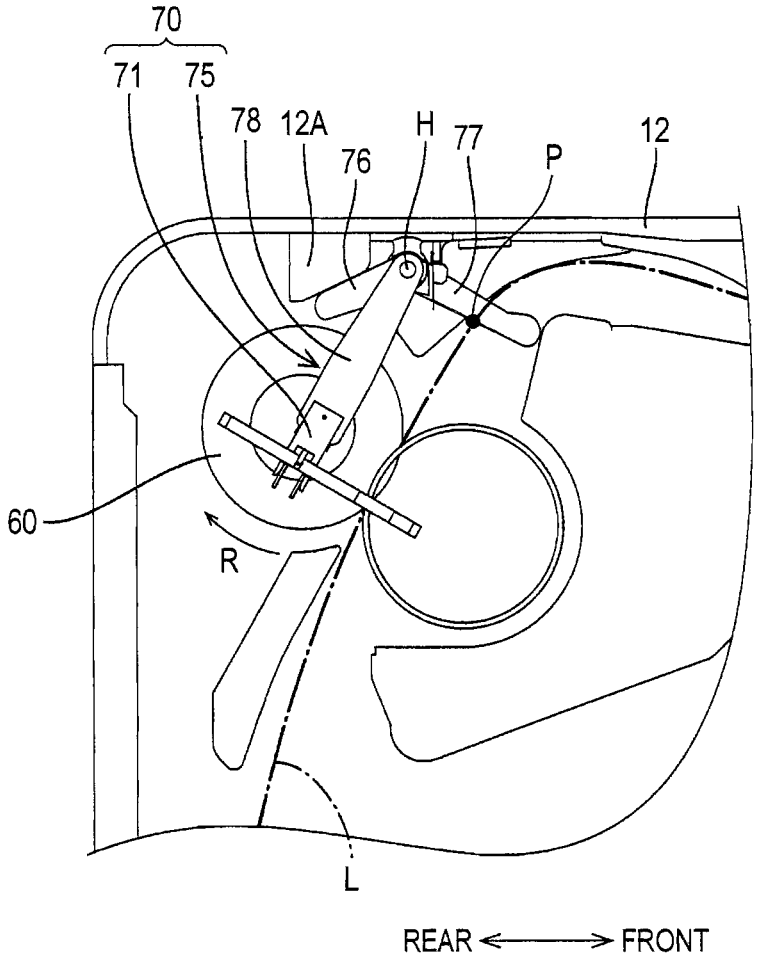
FIG. 4 is a schematic view showing the paper discharge sensor and the surrounding parts (showing an interlocking member in a first orientation)

The interlocking member 75 is urged in the direction shown by the arrow R in FIG. 4, by a spring (not shown). In a state where the top cover 12 is closed and the paper 5 is not detected, as shown in FIG. 4, the interlocking member 75 is in a first orientation that the first arm 76 is in contact with a protrusion 12A provided at the top cover 12. In the first orientation, the second arm 77 is located at the detection position P on the conveying path L, and the third arm 78 is located between the light emitting element and the light receiving element of the photoelectric sensor 71, so as to prevent light from entering the light receiving element. Hence, in a state where the top cover 12 is closed and the paper 5 is not detected, the paper discharge sensor 70 is OFF.

Figure 5:
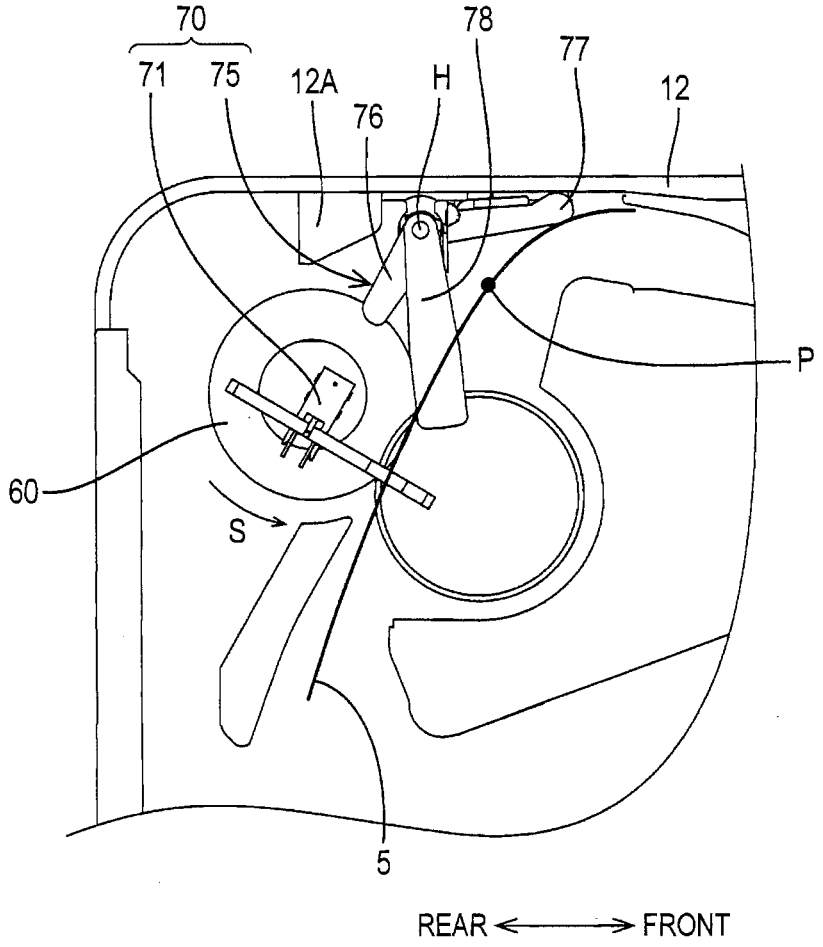
FIG. 5 is a schematic view showing the paper discharge sensor and the surrounding parts (showing the interlocking member in a second orientation)

On the other hand, as shown in FIG. 5, while the paper 5 fed along the conveying path L is passing through the detection position P, the second arm 77 is pressed by the paper 5. Thus, the interlocking member 75 rotatably moves in the direction shown by the arrow S (FIG. 5) from the first orientation shown in FIG. 4 to a second orientation shown in FIG. 5. In the second orientation, the third arm 78 is located outside of the photoelectric sensor 71 so as to allow light to enter the light receiving element. Hence, in a state where the paper 5 is detected, the paper discharge sensor 70 is ON.

Figure 6:
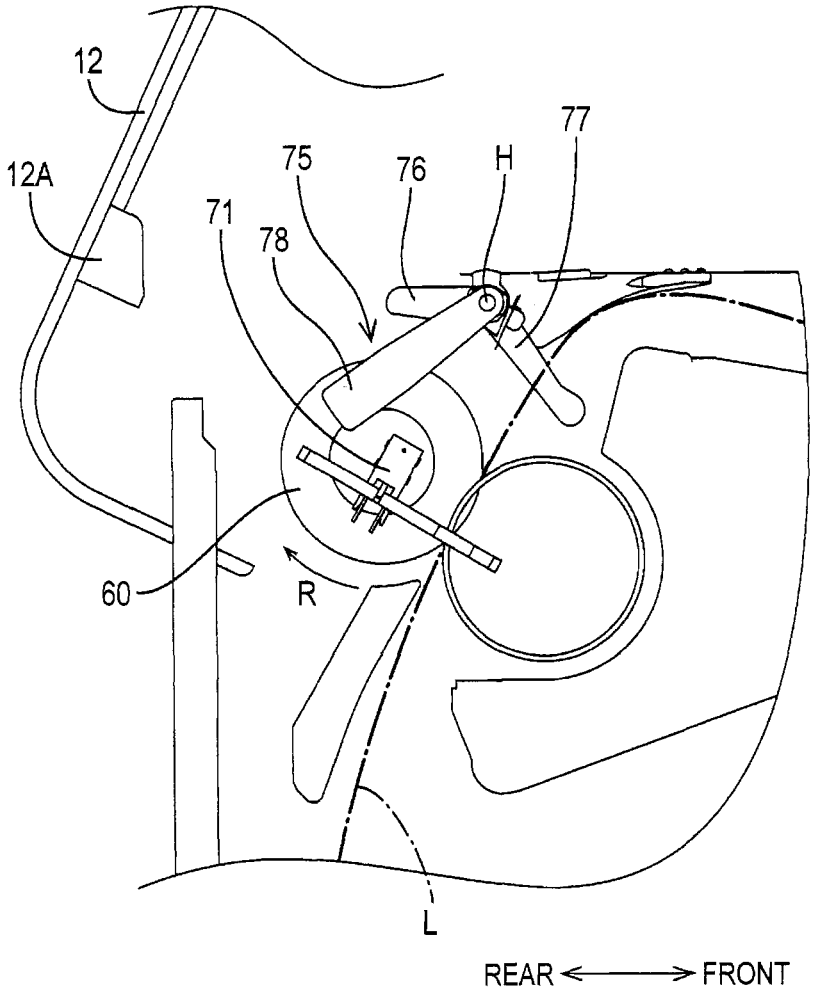
FIG. 6 is a schematic view showing the paper discharge sensor and the surrounding parts (showing the interlocking member in a third orientation)

Further, as shown in FIG. 6, in a state where the top cover 12 is opened, the protrusion 12A provided at the top cover 12 separates from the first arm 76, and the interlocking member 75 rotatably moves in the direction shown by the arrow R (FIG. 6) from the first orientation shown in FIG. 4 to a third orientation shown in FIG. 6. In the third orientation, like the second orientation, the third arm 78 is located outside of the photoelectric sensor 71 so as to allow light to enter the light receiving element. Hence, in a state where the top cover 12 is opened, the paper discharge sensor 70 is ON.

In this way, the paper discharge sensor 70 is OFF in a state where the top cover 12 is closed and where the paper 5 is not detected at the detection position P on the conveying path L (non-detection state). Further, the paper discharge sensor 70 is ON when at least one of a cover-open state and a detection state is satisfied, where the cover-open state is a state in which the top cover 12 is opened and the detection state is a state in which the paper 5 is detected at the detection position P on the conveying path L. Note that the paper discharge sensor 70 is an example of a second sensor. Also, the OFF output of the paper discharge sensor 70 is an example of a first output, and the ON output of the paper discharge sensor 70 is an example of a second output.

4. Electrical Configuration of Printer

As shown in FIG. 7, the printer 1 includes a main motor 91, the exposing section 50, the fixing unit 60, a high-voltage generating circuit 93, an operating section 95, a displaying section 97, the BD sensor 59, the paper discharge sensor 70, a controller 80, and a network interface 100. The main motor 91 serves as a driving source of various rollers constituting the conveying mechanism, the photosensitive drum 41, and the like. The high-voltage generating circuit 93 generates high voltages that are applied to the charger, the developing roller, the transfer roller 43, and the like.

The operating section 95 includes buttons and keys and, through the buttons and keys, receives various input operations such as a print instruction on the paper 5 by the user. The displaying section 97 includes a liquid crystal display, lamps, etc., and displays various setting screens, operation states, and the like through the liquid crystal display, the lamps, etc. The network interface 100 is connected to an information terminal apparatus such as a PC and a facsimile through a communication line NT, and performs mutual data communications with the information terminal apparatus.

The controller 80 serves to control the printer 1, and includes a CPU 81, a ROM 83, a RAM 85, and a timer 87 that measures time. The ROM 83 stores various programs for controlling the printer 1, such as a cover-open detection sequence described later. The RAM 85 stores various data. Upon reception of a print job from the information terminal apparatus, the CPU 81 of the controller 80 executes the printing process to print an image based on image data on the paper 5. The timer 87 is used to check detection timing of an output of the paper discharge sensor 70 in the cover-open detection sequence described below (S60, S120).

5. Cover-Open Detection Sequence

Next, the cover-open detection sequence executed by the controller 80 will be described while referring to FIGS. 8 through 12. The cover-open detection sequence is executed when the power of the printer 1 is turned on. Here, it is assumed that the top cover 12 is closed before the power of the printer 1 is turned on.

When the power of the printer 1 is turned on, first, the controller 80 executes a preparation operation of the printing section 40 (S10). Specifically, the controller 80 executes processes of rotating the photosensitive drum 41 and of agitating developer.

Then, when the preparation operation is completed, the process advances to S20. In S20, the controller 80 checks an output of the paper discharge sensor 70, and determines whether the output of the paper discharge sensor 70 is OFF. During a period after the preparation operation is finished and before printing is started, because there is no paper 5 fed from the tray 7 (no paper feeding state), the paper discharge sensor 70 does not detect the paper 5. Hence, if the top cover 12 is closed, the output of the paper discharge sensor 70 is OFF, and the process advances to S30.

In S30, the controller 80 executes a process of determining whether printing is to be started. If no print job is received (S30: No), the controller 80 determines that printing is not to be started, and the process returns to S20. Hence, until a print job is received from the information terminal apparatus, the controller 80 repeats the process of determining whether the output of the paper discharge sensor 70 is OFF (S20), while monitoring the output.

If a print job is received (S30: Yes), the controller 80 determines that printing is to be started, and the process advances to S40. In S40, the controller 80 controls the polygon motor 55 and the main motor 91 to rotate (time t0 in FIG. 9), and subsequently controls the laser light source 51 to light on (time t1 in FIG. 9). Note that the process of S40 executed by the controller 80 is an example of a lighting process.

Subsequently, the process advances to S50. In S50, the controller 80 executes a process of feeding paper 5. Specifically, a paper feeding solenoid (not shown) is activated to rotate the paper feeding roller 31. With this operation, the paper 5 is fed from the tray 7 and is sent along the conveying path L (time t2 in FIG. 9).

Subsequent to S50, the process advances to S60 and the controller 80 executes a process of detecting the output of the paper discharge sensor 70. Specifically, the controller 80 detects whether the output of the paper discharge sensor 70 is ON or OFF, and stores the detection result in the RAM 85 together with time information that is detected by the timer 87. The reason why the time information is stored together with the detection result is to be able to determine at which time point the detection result is obtained. Subsequently, the process advances to S70. In S70, the controller 80 executes a process of checking the output of the BD sensor 59 and of detecting whether the BD sensor 59 outputs the BD signal S1 with a scanning cycle T of laser light scanned by the polygon mirror 53. Note that the scanning cycle T is calculated from an equation (1) described later.

If the BD signal S1 is not outputted for a period longer than the scanning cycle T, it is determined that there is no output of the BD signal S1. If there is no output of the BD signal S1, the controller 80 determines that the top cover 12 is opened. In this case, a NO determination is made in S70, and the process advances to S110. On the other hand, if the BD sensor 59 outputs the BD signal S1 with the scanning cycle T, it is determined that there is an output of the BD signal S1. If there is an output of the BD signal S1, the controller 80 determines that the top cover 12 is closed. In this case, a YES determination is made in S70.

Figure 9:
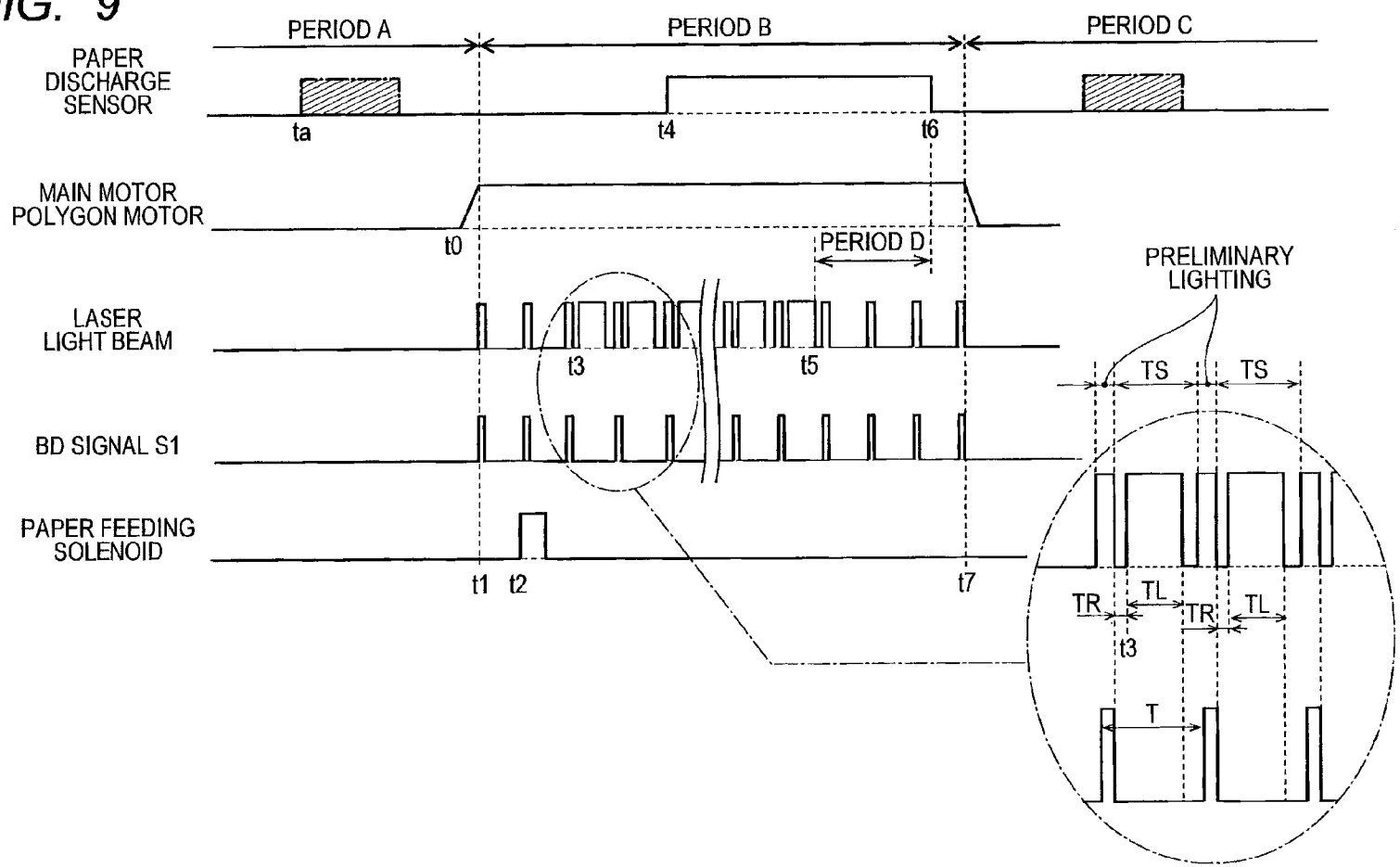
FIG. 9 is a timing chart showing operation timings of each component in a printing process.

That is, if the top cover 12 is closed while the laser light source 51 is lighting, as shown in FIG. 9, the BD signal S1 is outputted with the scanning cycle T. Thus, a YES determination is made in S70, and the process advances to S80. In S80, the controller 80 determines whether printing is finished. If printing is not finished (S80: No), the process returns to S60. Based on the above, except a case where a NO determination is made in S70, completion of printing is awaited while repeating the processes of S60, S70, and S80 sequentially. Note that the process of S70 executed by the controller 80 is an example of a first determining process.

When feeding of the paper 5 is started at time t2, the controller 80 executes an exposing process of forming an image based on image data on the photosensitive drum 41, while conveying the paper 5 (time t3 in FIG. 9). At this time, the controller 80 determines exposure start timing at which exposure with laser light is started, that is, writing start timing at which writing of each scan line on the photosensitive drum 41 is started in accordance with image data, by using, as the reference, output timing of the BD signal S1 outputted from the BD sensor 59.

Specifically, the controller 80 performs preliminary lighting of outputting a BD forcible lighting signal prior to forming each scan line for forcibly lighting the laser light source 51. Then, after the preliminary lighting is started, the controller 80 monitors whether the BD sensor 59 detects the BD signal S1 within a predetermined BD detection period.

At a time point when the BD signal S1 is detected, the controller 80 stops outputting of the BD forcible lighting signal to stop preliminary lighting. Subsequently, when a predetermined preparation period TR elapses, the controller 80 performs ON/OFF control of the laser light source 51 based on the image data, thereby forming one scan line on the photosensitive drum 41 (a period TL in FIG. 9). After a predetermined scan permission period TS elapses from a time point when the preliminary lighting is stopped, preliminary lighting for forming the next scan line is started.

The controller 80 repeatedly executes the above-described lighting control of the laser light source 51, thereby sequentially forming a plurality of scan lines on the photosensitive drum 41. If the controller 80 normally detects the BD signal S1, the output cycle (interval) of the BD signal S1 substantially matches the above-mentioned scanning cycle T by the polygon mirror 53, and each scan line is sequentially formed on the photosensitive drum 41 by using, as the reference, a time point when the BD signal S1 is detected. Accordingly, a writing start position of each scan line on the photosensitive drum 41 can be made uniform.

Note that the scanning cycle T of the polygon mirror 53 can be calculated from the following equation (1).

$$T=1/(N\times f) \quad (1)$$

Here, "N" is the number of faces of the polygon mirror 53 (eight in the present embodiment), and "f" is the number of rotations per unit time [Hz] of the polygon mirror 53.

And, when the paper 5 passes through the transfer position O, a developer image formed on the photosensitive drum 41 is transferred onto the paper 5. Subsequently, while the paper 5 passes between the both rollers 61 and 63 of the fixing unit 60, the transferred developer image is thermally fixed on the paper 5. Subsequently, the paper 5 is conveyed toward the paper discharge sensor 70 along the conveying path L.

Then, at time t4 when the leading end of the paper 5 reaches the detection position P on the conveying path L, the output of the paper discharge sensor 70 changes from OFF to ON. Subsequently, the paper discharge sensor 70 maintains ON, and changes to OFF at time t6 when the trailing end of the paper 5 passes through the detection position P.

The controller 80 determines that the printing process is finished when the output of the paper discharge sensor 70 changes to OFF after the output maintains ON for a period from when the leading end of the paper 5 passes through the detection position P until when the trailing end of the paper 5 passes through the detection position P. Subsequently, the process advances to S90 to execute processes of stopping the polygon motor 55, the main motor 91, and the laser light source 51 (time t7). Subsequently, the process returns to S20 where the controller 80 awaits reception of a print job while monitoring the output of the paper discharge sensor 70.

Next, a case will be described in which the top cover 12 is opened during a non-lighting period of the laser light source 51 (Period A and Period C in FIG. 9). For example, if the top cover 12 is opened in a period A in FIG. 9 in which reception of the initial print job is awaited after the power of the printer 1 is turned on, the output of the paper discharge sensor 70 changes from OFF to ON (time to in FIG. 9). In this case, a NO determination is made in S20, and the controller 80 determines that the top cover 12 is opened. Then, if a NO determination is made in S20, the process advances to S100 in which cover-open processing operation 1 is executed. Note that the process in S20 executed by the controller 80 is an example of a second determining process.

5-1. Cover-Open Processing Operation 1

Figure 10:
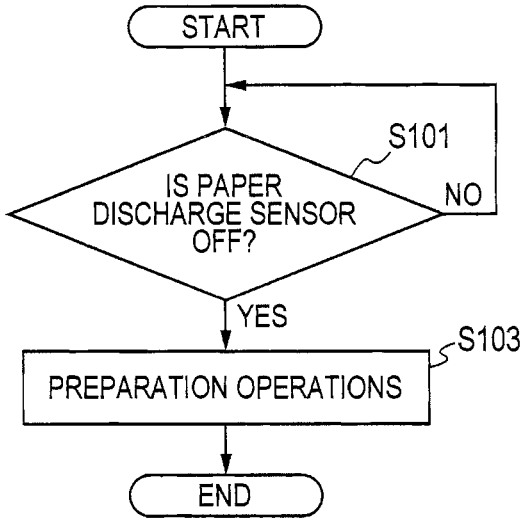
FIG. 10 is a flowchart showing the process flow of cover-open processing operation 1.
Figure 11:
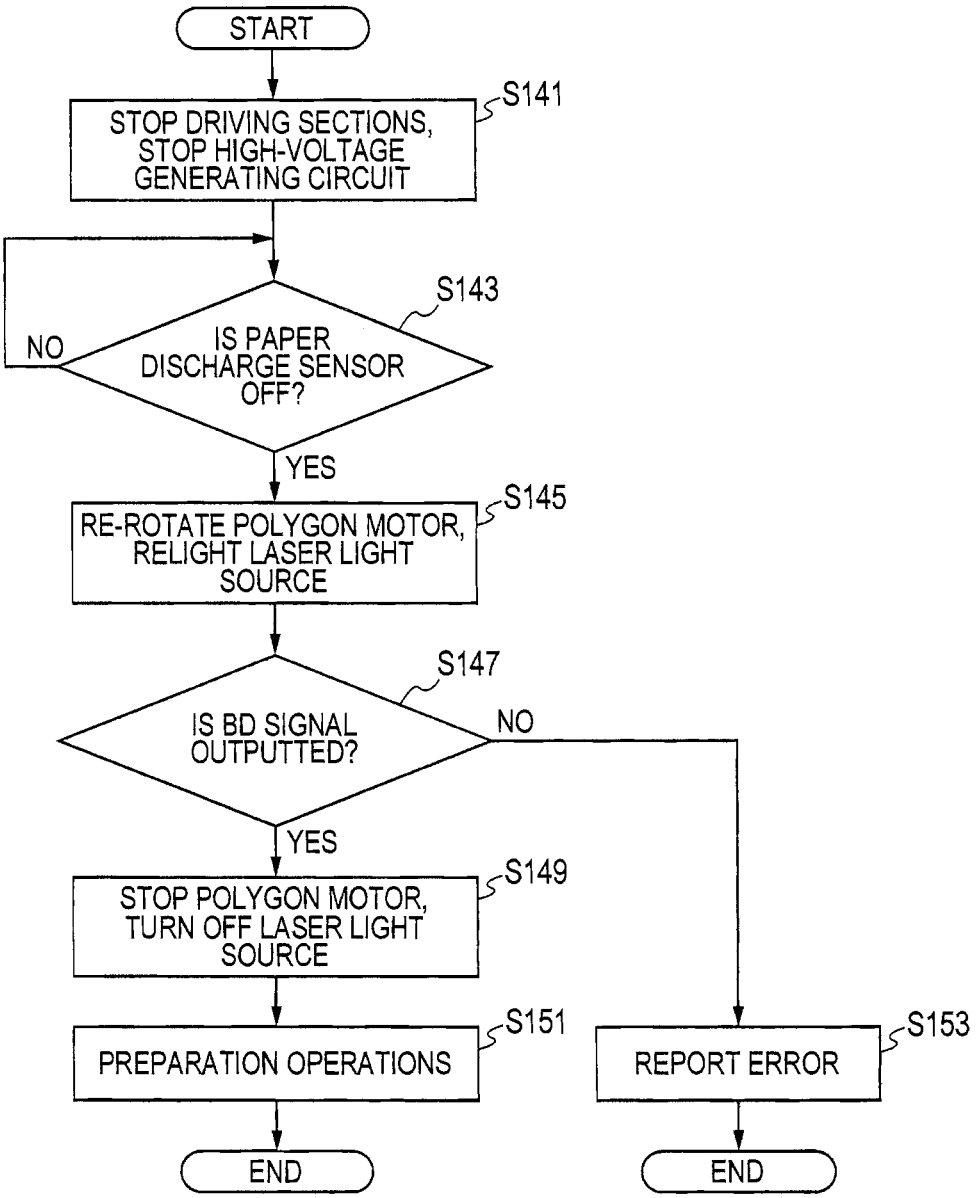
FIG. 11 is a flowchart showing the process flow of cover-open processing operation 2.
Figure 12:
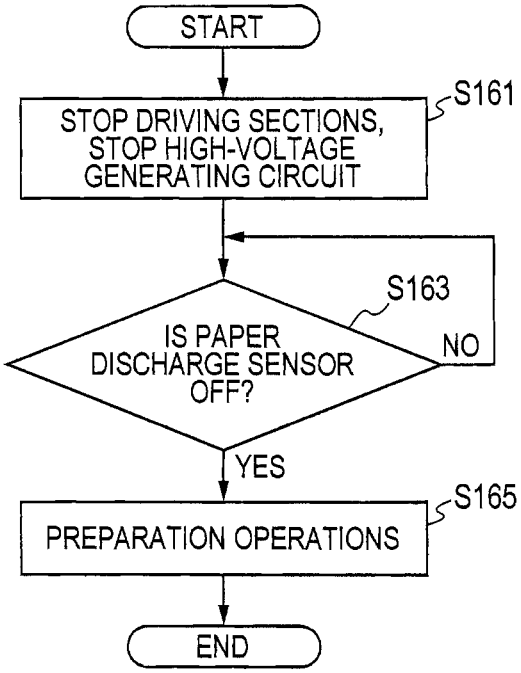
FIG. 12 is a flowchart showing the process flow of cover-open processing operation 3.

As shown in FIG. 10, the cover-open processing operation 1 of S100 includes the processes of S101 and S103. First, in S101, the controller 80 executes a process of determining whether the paper discharge sensor 70 is OFF. During a period in which the top cover 12 is opened, because the output of the paper discharge sensor 70 is ON, a NO determination is made in S101. If a NO determination is made in S101, the determining process of S101 is executed again. Hence, during a period in which the output of the paper discharge sensor 70 is ON, the process of S101 is repeated while waiting for the output of the paper discharge sensor 70 to change from ON to OFF.

Then, when the user closes the top cover 12, the output of the paper discharge sensor 70 changes from ON to OFF. Hence, a YES determination is made in S101, and the process advances to S103. In S103, the controller 80 executes preparation operations of the printing section 40, like S10. Subsequently, the process returns to S20 in the cover-open detection sequence shown in FIG. 8, where reception of a print job is awaited while monitoring the output of the paper discharge sensor 70. In this way, in the present embodiment, during the non-lighting period of the laser light source 51, it is detected whether the top cover 12 is opened based on the output of the paper discharge sensor 70.

Next, a case will be described in which the top cover 12 is opened during a lighting period of the laser light source 51

(Period B in FIG. 9). If the top cover 12 is opened while the laser light source 51 is lighting, the shutter 57 is moved to block the laser light source 51. Hence, if the top cover 12 is opened for a period longer than the scanning cycle T, reception of laser light by the BD sensor 59 is blocked. Thus, the BD signal S1 is not outputted from the BD sensor 59 for a period longer than the scanning cycle T. Accordingly, if the top cover 12 is opened during the lighting period of the laser light source 51 (Period B in FIG. 9), a NO determination is made in S70 and the process advances to S110.

In S110, the controller 80 executes processes of stopping the polygon motor 55 and of turning off the laser light source 51. Subsequently, in S120, the controller 80 executes a process of detecting the output of the paper discharge sensor 70. Specifically, the controller 80 detects whether the output of the paper discharge sensor 70 is ON or OFF, and stores the detection result in the RAM 85 together with time information that is detected by the timer 87. The reason why the time information is stored together with the detection result is to be able to determine at which time point the detection result is obtained.

Subsequent to the process in S120, the process advances to S130. In S130, the controller 80 determines whether the output of the paper discharge sensor 70 detected in S60 and stored in the RAM 85 (that is, the output of the paper discharge sensor 70 immediately before the top cover 12 is opened) is the same as the output of the paper discharge sensor 70 detected in S120 and stored in the RAM 85 (that is, the output of the paper discharge sensor 70 immediately after the top cover 12 is opened). Specifically, the controller 80 executes whether both the output of the paper discharge sensor 70 detected in S60 and the output of the paper discharge sensor 70 detected in S120 are ON. By executing this process, it can be determined whether the top cover 12 is opened in a state where the paper 5 exists at the detection position P on the conveying path L.

That is, if the paper 5 exists at the detection position P on the conveying path L (see FIG. 5), the output of the paper discharge sensor 70 is ON immediately before the top cover 12 is opened. And, after the top cover 12 is opened, the output of the paper discharge sensor 70 is still ON. Hence, if the output of the paper discharge sensor 70 remains ON and is unchanged before and after the top cover 12 is opened, the controller 80 determines that the paper 5 exists at the detection position P of the conveying path L and that the top cover 12 is opened (S130: Yes). In this case, cover-open processing operation 2 in S140 is executed.

On the other hand, if the paper 5 does not exist at the detection position P on the conveying path L (see FIG. 4), the output of the paper discharge sensor 70 is OFF immediately before the top cover 12 is opened. And, after the top cover 12 is opened, the output of the paper discharge sensor 70 becomes ON (see FIG. 6). Hence, if the output of the paper discharge sensor 70 changes from OFF to ON before and after the top cover 12 is opened, the controller 80 determines that the paper 5 does not exist at the detection position P of the conveying path L and that the top cover 12 is opened (S130: No). In this case, cover-open processing operation 3 in S160 is executed. Note that the process in S130 executed by the controller 80 is an example of a third determining process.

5-2. Cover-Open Processing Operation 2

If a YES determination is made in S130, cover-open processing operation 2 in S140 is executed. The cover-open processing operation 2 includes processes of S141-S153 shown in FIG. 11.

First, in S141, the controller 80 executes processes of stopping driving sections such as the main motor 91 etc. and the high-voltage generating circuit 93. Subsequently, the process advances to S143. In S143, the controller 80 executes a process of detecting whether the output of the paper discharge sensor 70 is OFF. The output of the paper discharge sensor 70 is ON, while the top cover 12 is open, or while the top cover 12 is closed and the paper 5 is not removed from the detection position P on the conveying path L. Thus, a NO determination is made in S143. If a NO determination is made in S143, the process returns to S143. Hence, the process in S143 is repeated during a period in which the output of the paper discharge sensor 70 is ON, while waiting for the output of the paper discharge sensor 70 to change from ON to OFF. Note that the process in S143 executed by the controller 80 is an example of a fourth determining process.

And, when the paper 5 is removed by the user from the detection position P on the conveying path L and the top cover 12 is closed, the output of the paper discharge sensor 70 becomes OFF. Thus, a YES determination is made in S143, and the process advances to S145. In S145, the controller 80 executes processes of re-rotating the polygon motor 55 and of relighting the laser light source 51. Note that the process in S145 executed by the controller 80 is an example of a relighting process.

Subsequently, the process advances to S147. In S147, the controller 80 executes a process of detecting whether the BD sensor 59 outputs the BD signal S1 with the scanning cycle T.

If the BD sensor 59 outputs the BD signal S1 with the scanning cycle T, the controller 80 determines that the paper 5 is removed from the detection position P and the top cover 12 is closed. In this case, a YES determination is made in S147, and the process advances to S149. In S149, the controller 80 executes processes of stopping the polygon motor 55 and of turning off the relighted laser light source 51. Then, the process advances to S151 and the controller 80 executes preparation operations of the printing section 40, like S10. Subsequently, the process returns to S20 in the cover-open detection sequence shown in FIG. 8, where reception of the next print job is awaited while monitoring the output of the paper discharge sensor 70.

Note that the reason why the processes in S145, S147, and S149 are provided in the cover-open processing operation 2 is that there is a possibility that, when the paper 5 is removed from the detection position P, the interlocking member 75 of the paper discharge sensor 70 rotatably moves, and the output of the paper discharge sensor 70 becomes OFF regardless of the fact that the top cover 12 is open. That is, when the interlocking member 75 moves to the first orientation shown in FIG. 4 by an operation of removing the paper 5, there is a possibility that the output of the paper discharge sensor 70 is OFF even in a state where the top cover 12 is open.

Hence, in the present embodiment, after the output of the paper discharge sensor 70 becomes OFF, the laser light source 51 is relighted to check the output of the BD signal S1, thereby reliably checking whether the top cover 12 is closed (S145-S149). That is, if the top cover 12 is closed, the BD sensor 59 outputs the BD signal S1 with the scanning cycle T in response to relighted laser light. Hence, if a YES determination is made in S147, it can be determined reliably that the top cover 12 is closed.

On the other hand, if the top cover 12 is not closed and if, due to an operation of removing the paper 5 from the detection position P, the interlocking member 75 of the paper discharge sensor 70 rotatably moves and the output of the paper discharge sensor 70 becomes OFF, relighted laser light is blocked by the shutter 57 and the BD sensor 59 does not output the BD signal S1. If the BD sensor 59 does not output the BD signal S1, the controller 80 determines that an error occurs. So, a NO determination is made in S147, and in S153 the controller 80 executes a process of reporting the error via the displaying section 97. Note that, in a case where the laser light source 51, the BD sensor 59, or the shutter 57 has a failure, too, the BD sensor 59 may fail to output the BD signal S1. In this case, a NO determination is made in S147, and the controller 80 reports an error in S153.

5-3. Cover-Open Processing Operation 3

If a NO determination is made in S130, then cover-open processing operation 3 in S160 is executed. The cover-open processing operation 3 includes the processes of S161-S165 shown in FIG. 12.

First, in S161, the controller 80 executes processes of stopping driving sections such as the main motor 91 etc. and the high-voltage generating circuit 93. Subsequently, the process advances to S163. In S163, the controller 80 executes a process of detecting whether the output of the paper discharge sensor 70 is OFF. Because the output of the paper discharge sensor 70 is ON while the top cover 12 is open, a NO determination is made in S163. If a NO determination is made in S163, the process returns to S163. Hence, the process in S163 is repeated during a period in which the output of the paper discharge sensor 70 is ON, while waiting for the output of the paper discharge sensor 70 to change from ON to OFF.

And, when the top cover 12 is closed by the user, the output of the paper discharge sensor 70 becomes OFF. Thus, a YES determination is made in S163, and the process advances to S165. In S165, when the controller 80 detects removal of the remaining paper 5 of which the leading end is located on the conveying path L between the paper feeding roller 31 and the paper discharge sensor 70, the controller 80 executes preparation operations of the printing section 40. Note that a method of detecting removal of the paper 5 mentioned above may be, for example, detecting a change from a state in which an output of a paper sensor (not shown) provided on the conveying path L between the conveying rollers 33A and photosensitive drum 41 indicates detection of the paper 5 to a state in which the output of the paper sensor indicates no detection of the paper 5. Subsequently, the process returns to S20 in the cover-open detection sequence shown in FIG. 8, where reception of the next print job is awaited while monitoring the output of the paper discharge sensor 70.

6. Advantageous Effects

As described above, the present embodiment utilizes the configuration in which the shutter 57 movable in an interlocking manner with open/close movement of the top cover 12 changes a reception state of laser light by the BD sensor 59 in accordance with an open/close state of the top cover 12, and it is determined using software whether the top cover 12 is in an open state based on the output of the BD sensor 59. Hence, opening of the top cover 12 can be determined, without providing an open/close sensor switch that mechanically detects an open/close state of the top cover 12. Accordingly, the apparatus can be downsized, compared with a case where the open/close state of the top cover 12 is detected mechanically.

Further, the BD sensor 59 has both functions of determining exposure start timing and of detecting opening of the top cover 12. Hence, the number of sensors can be reduced compared with a case where a dedicated sensor is provided for each of these functions, thereby downsizing the apparatus.

Further, because the BD signal itself is not outputted during non-lighting periods of laser light (period A and period C in FIG. 9), opening of the top cover 12 cannot be determined based on the output of the BD sensor 59. In this regard, in the printer 1 of the present embodiment, opening of the top cover 12 is determined based on the output of the paper discharge sensor 70 during the non-lighting period of laser light. Hence, opening of the top cover 12 can be detected during the non-lighting period as well as the lighting period of laser light. In other words, by using the BD sensor 59 and the paper discharge sensor 70 in a complementary manner, opening of the top cover 12 can be detected both during the lighting period and during the non-lighting period of laser light.

Note that the reason why opening of the top cover 12 can be detected based on the output of the paper discharge sensor 70 during the non-lighting period of laser light (period A and period C in FIG. 9) is as follows. Assuming that the non-lighting period roughly matches a non-printing period, the paper 5 is not fed during the non-lighting period. Hence, during the non-lighting period, the output of the paper discharge sensor 70 does not become ON by detecting the paper 5. Thus, if the output of the paper discharge sensor 70 is ON, it can be determined that the top cover 12 is in an open state.

Further, in the present embodiment, the laser light source 51 is lighted from starting time t1 of a printing process until ending time t7 of the printing process. In this way, it can be determined whether the top cover 12 is in an open state based on the BD signal S1 outputted by the BD sensor 59 even during a period in which the paper discharge sensor 70 detects the paper 5 on which the printing process is finished. That is, if laser light is stopped at time t5 when exposure based on image data ends, after that, an open/close state of the top cover 12 cannot be detected by the BD sensor 59 during a period D (FIG. 9) in which the paper discharge sensor 70 detects the paper 5.

In this regard, in the present embodiment, the laser light source 51 is driven at least during a period in which the paper discharge sensor 70 detects the paper 5, that is, a period from time t4 to time t6 in FIG. 9. Hence, it can be determined whether the top cover 12 is in an open state based on the BD signal S1 outputted by the BD sensor 59 even during a period in which the paper discharge sensor 70 detects the paper 5 after exposure is finished.

<Modifications>

While the invention has been described in detail with reference to the above aspects thereof, it would be apparent to those skilled in the art that various changes and modifications may be made therein without departing from the scope of the claims.

(1) For example, in the above-described embodiment, the controller 80 includes the single CPU 81, the ROM 83, the RAM 85, and the like. Alternatively, the controller 80 may be constituted by a plurality of CPUs 81, may be constituted by an ASIC, or may be constituted by a combination of one or more CPU and ASIC. Also, the above-described functions of the controller 80 may be executed by software, hardware, or a combination of software and hardware.

(2) In the above-described embodiment, by using the BD sensor 59 and the paper discharge sensor 70 in a complementary manner, opening of the top cover 12 is detected both during the lighting period and during the non-lighting period of laser light. However, the technology disclosed in this specification is to at least detect an open/close state of the top cover 12 based on the output of the BD sensor 59 during the lighting period of laser light. Hence, it is not necessary to detect an open/close state of the top cover 12 using the paper discharge sensor 70.

(3) In the above-described embodiment, exposure start timing is determined and an open/close state of the top cover 12 is detected, based on the BD signal S1 outputted by the BD sensor 59. However, only the open/close state of the top cover 12 may be detected based on the BD signal S1 outputted by the BD sensor 59, and a control of determining the exposure start timing may be executed based on an output of a sensor that is provided separately, for example.

(4) In the above-described embodiment, the polygon mirror 53 is used as an example of a deflector that deflects laser light. However, a Galvano mirror or the like may be used as the deflector. Further, the cover to detect an open/close state is not limited to the top cover, but may be any cover that opens and closes.

What is claimed is:

1. An image forming apparatus comprising:

a casing;

a light source provided in the casing and configured to emit a light beam for forming an image;

a first sensor configured to receive the light beam emitted by the light source and to output a light reception signal;

a cover configured to open and close relative to the casing;

a shutter configured to prevent the first sensor from receiving the light beam when the cover is at an open position, and to allow the first sensor to receive the light beam when the cover is at a closed position; and a controller configured to:

execute a lighting process of lighting the light source;

execute a first determining process of determining whether the light reception signal is outputted from the first sensor, in response to the lighting process; and determine that the cover is at the open position upon determination in the first determining process that no light reception signal is outputted, wherein a conveying path is defined in the casing;

wherein the image forming apparatus further comprises:

a conveying section configured to convey a sheet along the conveying path; and a second sensor configured to generate a first output in a state where the cover is at the closed position and where no sheet is detected at a detection position on the conveying path, and to generate a second output when at least one of a cover-open state and a detection state is satisfied, the cover-open state being a state that the cover is at the open position, the detection state being a state that a sheet is detected at the detection position; and wherein the controller is configured to:

execute a second determining process of determining which of the first output and the second output is generated by the second sensor; and determine that the cover is at the open position upon determination in the second determining process that the second sensor generates the second output during a non-lighting process in which lighting is stopped.

2. The image forming apparatus according to claim 1, further comprising:

a photosensitive member; and a deflector configured to deflect the light beam emitted by the light source and to scan the photosensitive member with the light beam at a scanning cycle, wherein the first sensor is configured to output the light reception signal upon reception of the light beam deflected by the deflector; and wherein, in the first determining process, the controller is configured to determine that no light reception signal is outputted when the first sensor outputs no light reception signal for a period longer than the scanning cycle.

3. The image forming apparatus according to claim 2, wherein the controller is configured to determine exposure start timing at which exposure of the photosensitive member with the light beam is started, based on output timing of the light reception signal outputted from the first sensor.

4. The image forming apparatus according to claim 1, wherein the second sensor comprises a sheet discharge sensor that is disposed at a downstream side of a transfer position at which the image is transferred onto the sheet, the sheet discharge sensor being configured to detect the sheet subsequent to image formation at the detection position which is located at a downstream side of the transfer position; and wherein the controller is configured to execute the lighting process and the first determining process during a period from when a leading end of the sheet reaches the detection position until when a trailing end of the sheet passes the detection position, and to determine that the cover is at the open position when no light reception signal is outputted.

5. The image forming apparatus according to claim 1, wherein the controller is configured to:

upon determination in the first determining process that no light reception signal is outputted, execute a third determining process of determining whether an output of the second sensor changes before and after the first determining process; and determine that no sheet exists and that the cover is at the open position, when the output of the second sensor changes from the first output to the second output before and after the first determining process.

6. The image forming apparatus according to claim 1, wherein the controller is configured to:

upon determination in the first determining process that no light reception signal is outputted, execute a third determining process of determining whether an output of the second sensor changes before and after the first determining process; and determine that the sheet exists and that the cover is at the open position, when the output of the second sensor remains unchanged at the second output before and after the first determining process.

7. The image forming apparatus according to claim 6, wherein the controller is configured to, upon determination that the sheet exists and that the cover is at the open position, execute a fourth determining process of determining the output of the second sensor;

execute a relighting process of relighting the light source, upon determination in the fourth determining process that the output of the second sensor is the first output; and determine that the cover is closed when the light reception signal is outputted from the first sensor in response to the relighting process.

8. The image forming apparatus according to claim 7, wherein the controller is configured to determine that an error occurs when no light reception signal is outputted from the first sensor in response to the relighting process.

9. The image forming apparatus according to claim 1, wherein a protrusion is provided at the cover;

wherein the second sensor comprises:

a transmission-type sensor having a light emitting element configured to emit light and a light receiving element configured to receive the light emitted from the light emitting element; and an interlocking member configured to be rotatable about an axis and to take first, second, and third orientations, comprising:

a shaft portion elongated in a width direction of the conveying path and rotatably supported by the casing;

a first arm attached to the shaft portion and configured to be contacted by the protrusion when the cover is at the closed position;

a second arm attached to the shaft portion and configured to be contacted by the sheet passing through a detection position on the conveying path; and a third arm attached to the shaft portion and movable to a position between the light emitting element and the light receiving element and to a position outside of the transmission-type sensor;

wherein the interlocking member takes the first orientation in a state where the cover is at the closed position and where no sheet is located at the detection position;

wherein the interlocking member takes the second orientation in a state where the cover is at the closed position and where the sheet is located at the detection position; and wherein the interlocking member takes the third orientation in a state where the cover is at the open position and where no sheet is located at the detection position.

10. An image forming apparatus comprising:

a casing;

a light source provided in the casing and configured to emit a light beam for forming an image;

a first sensor configured to receive the light beam emitted by the light source and to output a light reception signal;

a cover configured to open and close relative to the casing;

a shutter configured to prevent the first sensor from receiving the light beam when the cover is at an open position, and to allow the first sensor to receive the light beam when the cover is at a closed position;

a controller configured to:

execute a lighting process of lighting the light source;

execute a first determining process of determining whether the light reception signal is outputted from the first sensor, in response to the lighting process; and determine that the cover is at the open position upon determination in the first determining process that no light reception signal is outputted;

a holder holding the shutter and configured to move integrally with the shutter between a preventing position at which the shutter prevents the first sensor from receiving the light beam and an allowing position at which the shutter allows the first sensor to receive the light beam;

an urging member provided at the casing and configured to urge the holder in a direction from the allowing position to the preventing position; and a pressing member provided at the cover and configured to press the holder to be positioned at the allowing position when the cover is at the closed position.

11. The image forming apparatus according to claim 10, further comprising:

a photosensitive member; and a deflector configured to deflect the light beam emitted by the light source and to scan the photosensitive member with the light beam at a scanning cycle, wherein the first sensor is configured to output the light reception signal upon reception of the light beam deflected by the deflector; and wherein, in the first determining process, the controller is configured to determine that no light reception signal is outputted when the first sensor outputs no light reception signal for a period longer than the scanning cycle.

12. The image forming apparatus according to claim 11, wherein the controller is configured to determine exposure start timing at which exposure of the photosensitive member with the light beam is started, based on output timing of the light reception signal outputted from the first sensor.

13. The image forming apparatus according to claim 11, wherein a conveying path is defined in the casing;

wherein the image forming apparatus further comprises:

a conveying section configured to convey a sheet along the conveying path; and a second sensor configured to generate a first output in a state where the cover is at the closed position and where no sheet is detected at a detection position on the conveying path, and to generate a second output when at least one of a cover-open state and a detection state is satisfied, the cover-open state being a state that the cover is at the open position, the detection state being a state that a sheet is detected at the detection position; and wherein the controller is configured to:

execute a second determining process of determining which of the first output and the second output is generated by the second sensor; and determine that the cover is at the open position upon determination in the second determining process that the second sensor generates the second output during a non-lighting process in which lighting is stopped.

14. The image forming apparatus according to claim 13, wherein the second sensor comprises a sheet discharge sensor that is disposed at a downstream side of a transfer position at which the image is transferred onto the sheet, the sheet discharge sensor being configured to detect the sheet subsequent to image formation at the detection position which is located at a downstream side of the transfer position; and wherein the controller is configured to execute the lighting process and the first determining process during a period from when a leading end of the sheet reaches the detection position until when a trailing end of the sheet passes the detection position, and to determine that the cover is at the open position when no light reception signal is outputted.

15. The image forming apparatus according to claim 13, wherein the controller is configured to:

upon determination in the first determining process that no light reception signal is outputted, execute a third determining process of determining whether an output of the second sensor changes before and after the first determining process; and determine that no sheet exists and that the cover is at the open position, when the output of the second sensor changes from the first output to the second output before and after the first determining process.

16. The image forming apparatus according to claim 13, wherein the controller is configured to:

upon determination in the first determining process that no light reception signal is outputted, execute a third determining process of determining whether an output of the second sensor changes before and after the first determining process; and determine that the sheet exists and that the cover is at the open position, when the output of the second sensor remains unchanged at the second output before and after the first determining process.

17. The image forming apparatus according to claim 16, wherein the controller is configured to, upon determination that the sheet exists and that the cover is at the open position, execute a fourth determining process of determining the output of the second sensor;

execute a relighting process of relighting the light source, upon determination in the fourth determining process that the output of the second sensor is the first output; and determine that the cover is closed when the light reception signal is outputted from the first sensor in response to the relighting process.

18. The image forming apparatus according to claim 17, wherein the controller is configured to determine that an error occurs when no light reception signal is outputted from the first sensor in response to the relighting process.

19. An image forming apparatus comprising:

a casing;

a photosensitive member;

a light source provided in the casing and configured to emit a light beam for forming an image on the photosensitive member;

a deflector configured to deflect the light beam emitted by the light source and to scan the photosensitive member with the light beam at a scanning cycle;

a first sensor configured to receive the light beam emitted by the light source and deflected by the deflector, and to output a light reception signal;

a cover configured to open and close relative to the casing;

a shutter configured to prevent the first sensor from receiving the light beam when the cover is at an open position, and to allow the first sensor to receive the light beam when the cover is at a closed position; and a controller configured to:

execute a lighting process of lighting the light source;

execute a first determining process of determining whether the light reception signal is outputted from the first sensor, in response to the lighting process; and determine that the cover is at the open position upon determination in the first determining process that no light reception signal is outputted;

wherein the first sensor is disposed at such a position that, when the deflector scans the photosensitive member with the light beam at the scanning cycle and when the deflector is at a predetermined angle, the first sensor receives the light beam deflected by the deflector and outputs the light reception signal at the scanning cycle, and wherein the controller is configured to determine that the cover is at the open position upon determination in the first determining process that no light reception signal for a period longer than the scanning cycle is outputted from the first sensor.

20. The image forming apparatus according to claim 19, wherein the controller is configured to determine exposure start timing at which exposure of the photosensitive member with the light beam is started, based on output timing of the light reception signal outputted from the first sensor.

* * * * *